US012114792B2

(12) United States Patent
Jäger et al.

(10) Patent No.: US 12,114,792 B2
(45) Date of Patent: Oct. 15, 2024

(54) DRINKING DEVICE

(71) Applicant: TEN-ACE GmbH, Munich (DE)

(72) Inventors: Tim Jäger, Munich (DE); Magdalena Jüngst, Munich (DE); Jannis Koppitz, Munich (DE); Fabian Schlang, Munich (DE)

(73) Assignee: air up group GmbH, Munich (DE)

( * ) Notice: Subject to any disclaimer, the term of this patent is extended or adjusted under 35 U.S.C. 154(b) by 675 days.

(21) Appl. No.: 17/415,566

(22) PCT Filed: Nov. 8, 2019

(86) PCT No.: PCT/EP2019/080708
§ 371 (c)(1),
(2) Date: Nov. 30, 2021

(87) PCT Pub. No.: WO2020/126210
PCT Pub. Date: Jun. 25, 2020

(65) Prior Publication Data

US 2022/0087456 A1 Mar. 24, 2022

(30) Foreign Application Priority Data

Dec. 19, 2018 (DE) ..... 10 2018 222 299.1

(51) Int. Cl.
*A47G 21/18* (2006.01)
*A47G 19/22* (2006.01)
(Continued)

(52) U.S. Cl.
CPC ..... *A47G 21/183* (2013.01); *A47G 19/2205* (2013.01); *B65D 23/104* (2013.01);
(Continued)

(58) Field of Classification Search
CPC ..... A47G 2400/04; A47G 21/183; B65D 2203/12; B65D 51/248; B65D 51/28;
(Continued)

(56) References Cited

U.S. PATENT DOCUMENTS 3,043,464 A * 7/1962 Cerasari ..... A61J 11/045 215/11.1
3,717,476 A * 2/1973 Harvey ..... B65D 77/283 426/123
(Continued)

FOREIGN PATENT DOCUMENTS

CN 2389124 Y 7/2000
CN 2461872 Y 11/2001
(Continued)

OTHER PUBLICATIONS

English Translation of Applicant Cited reference (DE 202016004961) (Year: 2016).*
(Continued)

*Primary Examiner* — Nathan J Jenness
*Assistant Examiner* — Jennifer Castriotta
(74) *Attorney, Agent, or Firm* — Wolf, Greenfield & Sacks, P.C.

(57) ABSTRACT

A drinking device for the retronasal perception of an aroma substance. The drinking device comprises a storage container for drinking liquid, a head part, which can be fastened on the storage container and has a mouth end, at least one exchangeable aroma container, through which air can flow and which can be fastened on the head part, and a drinking straw, which is fixed in the head part. The drinking straw includes a transport channel for drinking liquid and an air channel for transporting aromatized air. The transport channel extends from the storage container towards the mouth
(Continued)

end of the drinking device. The air channel extends from the at least one aroma container towards the mouth end.

11 Claims, 6 Drawing Sheets

(51) Int. Cl.

| | |
|---|---|
| ***B65D 23/10*** | (2006.01) |
| ***B65D 47/06*** | (2006.01) |
| ***B65D 51/24*** | (2006.01) |
| ***B65D 51/28*** | (2006.01) |
| ***B65D 63/10*** | (2006.01) |

(52) U.S. Cl.
CPC ..... *B65D 47/06* (2013.01); *B65D 51/242* (2013.01); *B65D 51/248* (2013.01); *B65D 51/28* (2013.01); *B65D 63/1018* (2013.01); *A47G 2400/04* (2013.01); *B65D 2203/12* (2013.01)

(58) Field of Classification Search
CPC .... B65D 51/242; B65D 47/06; B65D 23/104; B65D 63/1018
See application file for complete search history.

(56) References Cited

U.S. PATENT DOCUMENTS

| | | | | |
|---|---|---|---|---|
| 4,955,503 | A | 9/1990 | Propes | |
| 5,165,603 | A * | 11/1992 | Hahn | A45D 40/0068 206/823 |
| 5,635,229 | A | 6/1997 | Ray | |
| 6,045,833 | A * | 4/2000 | Landau | B65D 51/00 426/106 |
| 6,112,749 | A * | 9/2000 | Hall | A61J 11/003 215/11.1 |
| 6,502,712 | B1 | 1/2003 | Weber-Unger | |
| 7,005,152 | B2 * | 2/2006 | Landau | A47G 19/2227 426/106 |
| 8,272,532 | B2 | 9/2012 | Michaelian et al. | |
| 8,662,294 | B2 | 3/2014 | Benbassat | |
| 8,662,339 | B2 | 3/2014 | Sprunger | |
| 9,010,238 | B2 | 4/2015 | Bodum | |
| 9,968,209 | B2 * | 5/2018 | Maranon | A47F 7/286 |
| 10,328,172 | B2 * | 6/2019 | Griffis | B65D 41/34 |
| 11,564,516 | B2 | 1/2023 | Jäger et al. | |
| 2004/0261807 | A1 | 12/2004 | Dube et al. | |
| 2007/0062961 | A1 | 3/2007 | Rigas | |
| 2007/0088314 | A1 | 4/2007 | Gollier et al. | |
| 2008/0028353 | A1 | 1/2008 | Lu et al. | |
| 2008/0230079 | A1 | 9/2008 | Besso et al. | |
| 2008/0257853 | A1 | 10/2008 | Cappello | |
| 2009/0250479 | A1 * | 10/2009 | Kaufman | A47G 19/2272 220/713 |
| 2009/0266829 | A1 | 10/2009 | Bailey | |
| 2011/0094904 | A1 | 4/2011 | Lee | |
| 2013/0302477 | A1 | 11/2013 | Salinas | |
| 2014/0166680 | A1 * | 6/2014 | St. Gelais | A47G 21/183 220/710 |
| 2015/0030726 | A1 | 1/2015 | Binder et al. | |
| 2016/0046407 | A1 | 2/2016 | Lee | |
| 2018/0000269 | A1 * | 1/2018 | San Miguel | A47G 21/183 |
| 2019/0367230 | A1 * | 12/2019 | Griffis | A61L 9/12 |
| 2020/0178712 | A1 | 6/2020 | Jäger et al. | |

FOREIGN PATENT DOCUMENTS

| | | | |
|---|---|---|---|
| CN | 101578053 | A | 11/2009 |
| CN | 106820859 | A | 6/2017 |
| CN | 206380892 | U | 8/2017 |
| DE | 20 2016 004 961 | U1 | 9/2016 |
| DE | 20 2018 000 382 | U1 | 5/2018 |
| DE | 10 2018 003 669 | A1 | 1/2019 |
| EP | 1 056 660 | A1 | 3/2005 |
| EP | 2 496 118 | B1 | 10/2013 |
| JP | 2000-085777 | A | 3/2000 |
| JP | 2002-037304 | A | 2/2002 |
| JP | 2004-026304 | A | 1/2004 |
| JP | 2006-520722 | A | 9/2006 |
| JP | 2008-150056 | A | 7/2008 |
| JP | 2011-507771 | A | 3/2011 |
| JP | 2012-020783 | A | 2/2012 |
| KR | 20-2016-0004174 | U | 12/2016 |
| RU | 132 697 | U1 | 9/2013 |
| WO | WO 2019/016096 | A1 | 1/2019 |

OTHER PUBLICATIONS

International Search Report and Written Opinion for International Application No. PCT/EP2019/080708, mailed Mar. 5, 2020, with English translation thereof.

International Preliminary Report on Patentability for International Application No. PCT/EP2019/080708, mailed Jul. 1, 2021, with English translation thereof.

Galileo, "Wie reines Leitungswasser plötzlich Geschmack bekommt. Galileo. ProSieben" Youtube, Mar. 12, 2018 (Mar. 12, 2018), pp. 1-1, Retrieved from the Internet: https://www.youtube.com/watch?v=SiCL5J7_TMA [retrieved on Feb. 21, 2020].

Hrfernsehen. "Serie: Hessen innovativ—Joyce" YouTube, Dec. 5, 2017 (Dec. 5, 2017), pp. 1-1, Retrieved from the Internet: https://www.youtube.com/watch?v=1AfLGzcoRN8 [retrieved on Feb. 21, 2020].

* cited by examiner

DRINKING DEVICE

RELATED APPLICATIONS

This Application is a national stage filing under 35 U.S.C. § 371 of International Patent Application Serial No. PCT/EP2019/080708, filed Nov. 8, 2019, which claims priority to German application number 10 2018 222 299.1, filed Dec. 19, 2018. The entire contents of these applications are incorporated herein by reference in their entirety.

FIELD OF THE INVENTION

The invention relates to a drinking device for the retronasal perception of an aroma substance and an aroma container therefor.

PRIOR ART

There is an increasing need to ingest drinking liquids which on the one hand have a pleasant flavor but on the other prevent health risks which could be brought about by the ingestion of aroma substances or stabilizing agents dissolved in the drinking liquid. The ingestion of an increased quantity of calories is also to be avoided.

Water which has been given a slightly fruity aroma has therefore become popular in the last few years. However, in this aromatized water there are also undesired additives such as stabilizing agents and a certain proportion of sugar, which is why these aromatized beverages also have a quantity of calories which is rejected by many users.

A first step towards solving this problem consists in only adding the flavoring aroma to the beverage just before it is consumed, US 2008/028353 A1, US 2015/030726 A1 and U.S. Pat. No. 8,622,904 are examples of dosing systems with which an aroma substance originally provided separately is added to the drinking liquid and dissolved in it immediately before or during the consumption of the beverage, Although this measure allows problems such as the stabilization of the drinking liquid over a prolonged period of time to be avoided, the problem of the undesired ingestion of additives remains.

Since the olfactory sensation plays a significant part in gustatory perception in the consumption of food and beverages, systems to date have attempted to influence the smell perceived while drinking. To that end U.S. Pat. No. 5,635,229 proposes an aroma element which can be attached close to the drink opening on a drinking container so that the aroma element is in the immediate proximity of the nose of the user, who breathes through the nose while drinking and thereby perceives the aroma.

The drinking vessel according to U.S. Pat. No. 8,662,339 B2 also works on the principle that an aroma is inhaled through the nose while drinking.

PRESENTATION OF THE INVENTION

The object of the invention is to propose a drinking device which allows the user to have an improved taste experience.

This object is achieved by a drinking device having the feature of claim 1. Preferred embodiments follow from the other claims and the following description.

The drinking device according to the invention for the retronasal perception of an aroma substance comprises a storage container for drinking liquid, a head part, which can be fastened on the storage container and has a mouth end; an exchangeable aroma container, through which air can flow and which can be fastened on the head part, and a drinking straw comprising a transport channel for drinking liquid, said transport channel extending from the storage container towards the mouth end of the head part; and an air channel for transporting aromatized air, said air channel extending from the aroma container towards the mouth end in the head part.

The essential aspect of the drinking device according to the invention consists in that the aroma substance is perceived retronasally. During drinking, the aroma substance reaches the mouth of the user together with the drinking liquid and subsequently rises retronasally via the pharynx to the olfactory mucosa (regio olfactoria), where it is detected by the receptors situated there and is perceived by the user. The device according to the invention is equally suited for cold or warm drinking liquids.

Advantage is taken of the fact that there is a close correlation between the sense of smell and the sense of taste. The user therefore gains the impression that they are tasting the aroma, even though they are in fact only smelling it retronasally.

The human sense of taste is essentially determined by the retronasal sense of smell. The receptors of the tongue can only distinguish between sweet, sour, bitter, salty and umami, whereas the differentiated sense of taste arises in that the gaseous phase of foodstuffs and liquids in the pharynx ascends via the retronasal route and reaches the olfactory mucosa. The sensors located there trigger neurological stimuli which cause a taste impression in the brain. Thus, a person to whose pharynx an aroma is delivered during drinking gains the impression that the beverage is aromatized, since the retronasal smelling process creates the sensation in the brain that the beverage is the source of the aroma, even though the user is ingesting a pure and unadulterated, i.e. non-aromatized, liquid such as water. If the smell is perceived by breathing in through the nose, known as the orthonasal perception of an aroma substance, this impression does not arise to the same extent since the sensation is linked to the breathing rate and thus the user gains the correct impression that they are only smelling the aroma substance, but not tasting it as is the case with retronasal perception.

The storage container, which is preferably designed to be refillable, can contain pure water or carbonated water, while the aroma substance is delivered to the air situated in the transport channel and the drinking liquid immediately before ingestion by the user or is transported separately to the pharynx of the user.

Alternatively, however, the drinking liquid can also have an inherent taste. The existing inherent taste of the drinking liquid is either intensified by the aroma substance from the aroma container or is supplemented by one or more additional flavor components. If the storage container contains apple juice, for instance, apple aroma can be added to intensify the taste experience, or an orange aroma for instance can be added in order to create a blend of flavors. In this manner alcoholic beverages such as beer, for instance, can also be provided with additional aroma substances, whereby the particular preferences of a user can be catered for by using a corresponding aroma container in the drinking device according to the invention. In addition, flavors which are not common in the food sector can also be used in the drinking device disclosed here, such as "sandalwood", "spring meadow" or "unicorn" known from air fresheners. The aroma used can be synthetic or natural. It is possible to use aromas which have been isolated or enriched from a synthetic or natural source and natural substances such as fresh or processed products made, for example, of lemon peel, dandelion leaves, licorice or other aromatic substances.

Providing the aroma container on the head part of the drinking device has the additional advantage that the user can immediately recognize the "flavor". Thus, for instance, the aroma container could be labeled according to the chosen aroma or also be colored entirely and, for instance, have a yellow color for a lemon aroma or a green color for a green apple aroma.

In this regard, the drinking straw can be fastened on the head part in such a way that one end of the drinking straw is arranged a few centimeters, preferably between 2 cm and 5 cm, in front of the mouth end of the head part, and the aromatized air guided through the air channel enters the drinking liquid at the end of the drinking straw or in the immediate proximity of the end of the drinking straw. At the mouth end of the head part, the drinking liquid mixed with aromatized air is ingested by the user.

In the oral cavity of the user, the aromatized air escapes from the surrounding drinking liquid in the form of air bubbles and rises retronasally via the pharynx to the olfactory mucosa. A further advantage of separately delivering the aromatized air and the drinking liquid until directly in front of the mouthpiece consists in that at most a negligible mass transfer between the air and the drinking liquid can take place.

The technical challenge of all solutions described above consists in coordinating the geometries of the transport channel for drinking liquid and of the air channel with each other such that, depending on the drinking position and in the case of special drinking liquids and also depending on the viscosity of the drinking liquid, the aromatized air and the drinking liquid are sucked in at the desired proportion to one another.

According to a preferred embodiment, the exchangeable aroma container can be moved, in relation to the head part, in an axial direction from a sealing position to a non-sealing position. By means of a simple axial movement of the aroma container, said container can thus be moved from a sealing position to an operating position in which air can flow through the aroma container.

According to a preferred embodiment of the invention, the head part is arranged at an angle in relation to the storage container, preferably inclined at an angle between 20° and 30° in relation to the storage container, and particularly preferably inclined at an angle of approximately 25° in relation to the longitudinal axis of the storage container.

This measure has the advantage that the drinking device according to the invention has improved ergonomics and, moreover, it is intuitively clear to a user how to hold the drinking device. Due to the provision of a bend in the axial extension of the drinking device, the drinking device is tilted significantly less while drinking, thereby reducing the risk of accidentally spilling the drinking liquid. Moreover, the provision of a bend facilitates the filling process of the storage container by the user, in particular at water sources with a small distance between the faucet and the sink.

The angular arrangement of the head part in relation to the storage container can in particular also be combined with the further preferred feature, according to which the drinking straw has a sectional curvature in the longitudinal direction.

If the position of the storage container while drinking is defined and if the drinking straw moreover has an at least sectional curvature, the end of the drinking straw opposite to the mouth end can be positioned in such a way that it is possible to consume almost the entire content of the storage container.

A preferred embodiment of the drinking device is the provision of a lid which is either put or screwed on and thereby seals the drinking device, A rotating lid is well suited to sealing the drinking device tightly even when an increased pressure is building up in the interior of the storage container, as can occur if the drinking liquid is a carbonated beverage. Such a lid can tightly seal both the transport channel for drinking liquid and the air channel for aromatized air, but in the same manner also another air line for delivering air into the interior of the storage container for the purpose of equalizing pressure. A further advantage of a rotating lid is that it protects the mouthpiece from contamination and is thus an element that is familiar to every user, and the suitability of which for tightly sealing the drinking device is relied upon.

Preferably, the lid has a receiving means for attaching a carrying strap. The receiving means can be designed as a tongue-and-groove system, for example. In this way, different carrying straps can be comfortably fastened on the lid, and the drinking device can be individualized according to the user's wishes e.g. by the choice of color of the carrying strap. It can also be individualized by a different shape of the strap.

According to a preferred embodiment of the invention, the head part has an air chamber in connection with the air channel. Said air chamber is a safety buffer for buffering overpressure or negative pressure during and after drinking, and thus it can be avoided that drinking liquid can flow into the aroma container. This solves in particular the problem that the fluctuations in the pressure and flow conditions in the transport channel for drinking liquid and in the air channel, which occur at the drinking device at the end of the drinking process, lead to drinking liquid getting into the air channel and/or the aroma container. This ingress of liquid into the aroma container can, for instance, lead to unwanted dilution of the fragrance-emitting substance or the occurrence of hygiene problems. The interruption of the air channel by an air chamber can be configured by providing a recess in the head part of the drinking device where the transport channel for drinking liquid and the air channel come into contact.

The invention also comprises an aroma container for a drinking device for the retronasal perception of an aroma substance. The aroma container comprises an essentially annular aroma chamber comprising a carrier substance that contains a fluid with an aromatizing substance, wherein the aroma chamber is enclosed by a wall which comprises an interior circumferential surface, an exterior circumferential surface as well as a top side and a lower side, wherein the interior circumferential surface has a non-circular cross-section and is shaped in such a way that the aroma container can only be put in a single rotational direction onto a component shaped complementarily to the interior circumferential surface and can be shifted in an axial direction in relation to the component, at least one first opening for air to flow in, and at least one second opening for air to flow out.

The aroma container according to the invention, which can be fastened on the head part of the drinking device, surrounds—with its interior circumferential surface—the head part of the drinking device. Since the interior circumferential surface is shaped in such a way that the aroma container can only be put in a single rotational direction onto a component shaped complementarily to the interior circumferential surface, in this specific case onto the head part shaped complementarily to the interior circumferential surface, a flow-in opening in the head part can be aligned with the aroma container in such a way that the user, when drinking through the drinking straw, also sucks in aromatized air having flown through the aroma container, Since the aroma container can be shifted axially in a direction essentially perpendicular to the top side and the lower side, the aroma container can be moved between a locked position and an operating condition. In the locked position, there is no flow connection between the second opening of the aroma container and the air channel of the drinking straw. In the operating condition, on the other hand, the user can suck in air through the drinking straw, which is in flow connection with the second opening of the aroma container so that ambient air is sucked into the first opening of the aroma container, flows through the aroma chamber with the aromatizing substance, leaves the aroma container through the second opening as aromatized air, and flows into the air channel of the drinking straw.

According to a preferred embodiment of the invention, the at least one first opening for air to flow in is arranged in the lower side of the wall. The first opening or the first openings for air to flow in are arranged essentially on the exterior side of an essentially annular aroma container, for example, whereas the second opening or second openings for air to flow out are arranged essentially on the interior side of the aroma container. The provision of a plurality of second openings results in the advantage that the aroma container cannot only be positioned in a single alignment in relation to the head part of the drinking device, but a plurality of positions are possible in which one of the second openings are in flow connection with the air channel or air channels of the head part. Thus, handling is facilitated for the user, and other shapes of the aroma container are possible since a defined, relative positioning is no longer necessary.

Said positioning of the first opening in connection with the possibility of axially shifting the aroma container makes it possible to move the aroma container in the axial direction to a locked position, in which not only no flow connection exists between the second opening and the air channel of the drinking straw, but additionally the first opening can be brought in contact with a suitable part of the head part, whereby the first opening is also sealed in the locked position.

Thus, for instance, an aroma container with any desired prismatic geometry could be pressed in an axial direction in order to bring the aroma container into a non-sealing position. The aroma container can engage in this position, i.e. remain in this position automatically, or drinking with the delivery of an aroma is only possible if the aroma container is pulled out. In this manner, a user could additionally choose between drinking liquid with and without aromatized air.

The use of an essentially elastic material such as silicone or other elastomers for the production of the head part or parts of the head part of the drinking device can, for instance, make it easier to seal the system.

Preferably, the opening for air to flow out is arranged in the interior circumferential surface. In this manner, a flow connection can be easily established between the aroma container and the head part which abuts at the interior circumferential surface of the aroma container.

According to a preferred embodiment of the invention, the removable aroma container can be inserted into the drinking device according to the invention by means of a simple motion sequence. This can be achieved by the interior circumferential surface having a characteristic shape that is immediately recognized by the user in order to attach the aroma container in its correct position at the head part of the drinking device.

Particularly preferred, however, is the embodiment according to which the aroma container of the drinking device doubles as a locking device, by means of which the air channel as well as the first opening and the second opening of the aroma container can be locked tightly. In this regard, the aroma container according to a preferred variant of the invention is designed such that it can be moved from the sealing position to the non-sealing position by means of a translational motion. Consequently, the user just has to bring the aroma container into an operating position, causing the sealing device to be actuated without the user noticing. In this manner, the number of construction elements can be kept low, thereby enabling inter alia a more hygienic design and also a cost saving in the production and assembly of the drinking device. Moreover, almost every user knows the function of a sports valve so that the user intuitively pulls out the aroma container as a shiftable component for drinking and, after drinking, presses it back into its original position or screws on the lid, by means of which the aroma container can be moved back into its locked position.

The drinking device according to the invention can be designed in a wide variety of ways. It can be a mobile drinking bottle which is configured as a Thermos flask with either one or two walls.

Another preferred embodiment of the invention lies in that the transport channel for the drinking liquid and/or the air channel have a specific shape. It is, for instance, possible that the transport channel for the drinking liquid is widened or narrowed at one, two or more places, so that the diameter of the transport channel is greater or smaller there than at the other places, Narrowing or widening can be designed in the drinking straw of the drinking device. This enables a different mouthfeel of the user when drinking from the drinking device.

A further preferred modification of the geometry of the channels in the drinking device comprises different surfaces on the inside of the channel or obstacles which change the flow conditions in the transport channel for drinking liquid or in the air channel.

The air channel of the drinking device can also have a specific shape. Previous solutions use a consistently uniformly shaped channel. The air channel must thus have a small diameter, which means that problems occur when producing the head part of the drinking device. Furthermore, a narrow channel makes it more difficult to clean the drinking device. However, it is also possible for the air channel to be narrower only at a short stretch. This both simplifies production and makes cleaning easier.

A further preferred embodiment of the drinking device according to the invention provides for the aroma unit of the drinking device according to the invention to have to be activated before use. The aroma can initially be encapsulated microscopically or macroscopically. Activation can, for instance, occur through a change in temperature or a mechanical process. A preferred embodiment provides for a filter through which air can flow, in which an essentially round aroma unit is positioned whose interior contains a fluid comprising an aromatizing substance. The shell of the aroma unit preferably consists of a material such as gelatine or agarose, so that in the inactive state a tight shell keeps the fluid with the aromatized substance in a non-volatile state. The fluid is released into the surrounding filter by the activation, such as the destruction of the shell under pressure. Such solutions are proposed for use in cigarettes, for instance in US 20040261807 A1. According to the invention, in a preferred embodiment this technology is to be used in the drinking device according to the invention. This results in a number of advantages. For instance, it allows the aroma substances to be protected from oxidative processes, and generally packaging material can be saved and plastic seals avoided.

Common to all preferred embodiments and combinations of technical features set out above and below is that a mediated air flow through the air channel during normal drinking from the drinking device according to the invention expediently lies between about 250 and 550 ml/min. This air flow is achieved, for example, when using an air channel with a diameter of approximately 0.5 to 2.5 mm or with a non-circular cross-section having a cross-sectional area of the air channel between 0.2 $mm^2$ and 4.9 $mm^2$, The air flow can also be adjusted in another manner, such as by means of an essentially short narrowing of the air channel, by means of a valve which can also be configured as a check valve in order to prevent the ingress of liquid into the air channel and/or the aroma container, or by means of a membrane. An essentially permeable membrane can, for instance, be attached at the point where the air channel enters the transport channel for drinking liquid. A further advantage of the use of a membrane at this point is also that the fluctuations described above in the pressure and flow conditions when the drinking process ends do not lead to drinking liquid entering the air channel and/or the aroma container or its volume being reduced at this or any other moment.

BRIEF DESCRIPTION OF THE DRAWINGS

The invention is described below, merely by way of example, on the basis of the enclosed schematic figures, in which FIG. 1 schematically shows the functional principle of a drinking device according to the invention for the retronasal perception of an aroma substance.

DESCRIPTION OF PREFERRED EMBODIMENTS

In the following embodiments, the same construction elements will be designated with the same reference numbers.

Figure 1:
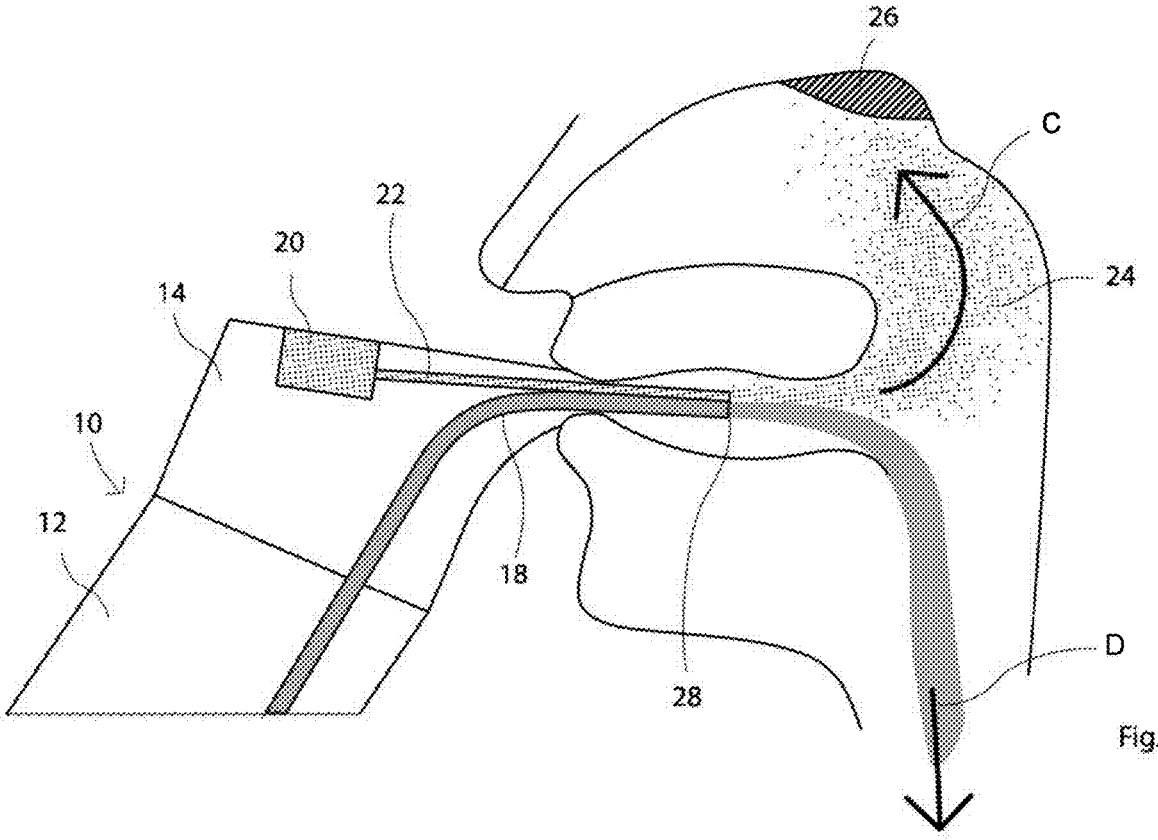

FIG. 1 schematically illustrates a drinking device 10 in which the individual components are shown in such a way that they are easily visible, without exactly following the embodiment described in more detail below. The drinking device consists of a storage container 12 filled with a pure drinking liquid as well as a head part 14. Herein, a pure drinking liquid is always understood to mean that drinking liquid which does not contain an aroma added by the drinking system according to the invention. The head part 14 comprises a mouthpiece which in this case is integrated in the head part but can also be provided separately. In the head part 14 is an aroma container 20 which is in flow connection with the ambient air in a manner not illustrated in FIG. 1, and from which an air channel 22 for transporting aromatized air leads away. Also provided is a transport channel 18 for drinking liquid, which in the present embodiment example extends like a straw into the pure liquid contained in the storage container 12.

When using the drinking device 10 according to the invention, both the pure liquid and the aromatized air are ingested orally, and the aromatized air proceeds via the retronasal route 24 in the direction of arrow C to the olfactory mucosa 26, where the aroma is detected by the receptors which are located in the olfactory mucosa, and the user gains the impression, via the neuronal processing of the sensory stimuli, that the pure liquid which the user is drinking (direction of arrow D) has the flavor added by the aroma.

It is advantageous if the contact between the aromatized air and the pure liquid is as short as possible. In this manner, undesired mass transfer of aroma substance between the air and the pure liquid is minimized, however, absorption of the aroma in the liquid cannot be excluded entirely. The shorter the period of contact between the air and the liquid, but also the smaller the total interface between air and liquid, the less the undesired mass transfer.

In order to be able to use the drinking device according to the invention in an expedient way, it must be ensured firstly that the aroma does not escape in an undesirable manner while the drinking device is being stored, and also that a drinking device already filled with pure drinking liquid cannot leak. Furthermore, the drinking device must also have an air channel between the interior of the storage container for drinking liquid and the ambient atmosphere, which serves to equalize the pressure and which introduces a volume of air into the drinking device corresponding to the volume of drinking liquid withdrawn from the drinking device during drinking. This air channel should also be provided with a suitable locking device to prevent undesired leaking of the drinking liquid.

Figure 2:
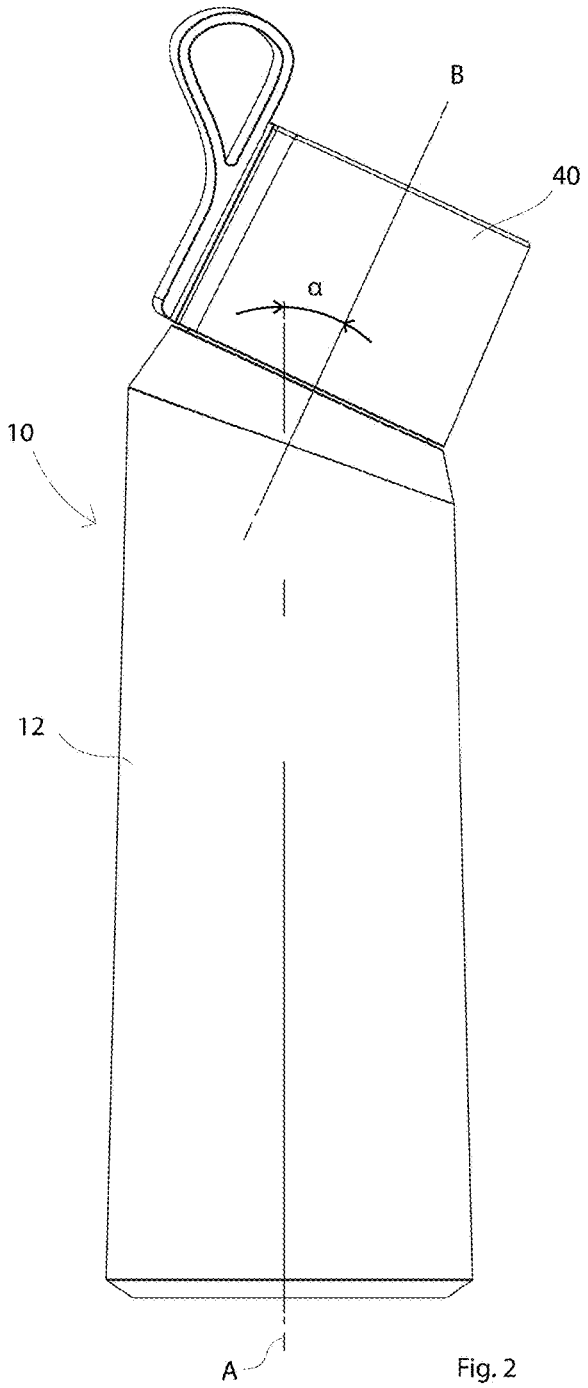
FIG. 2 shows a side view of a drinking device according to the invention with screwed-on lid.
Figure 3:
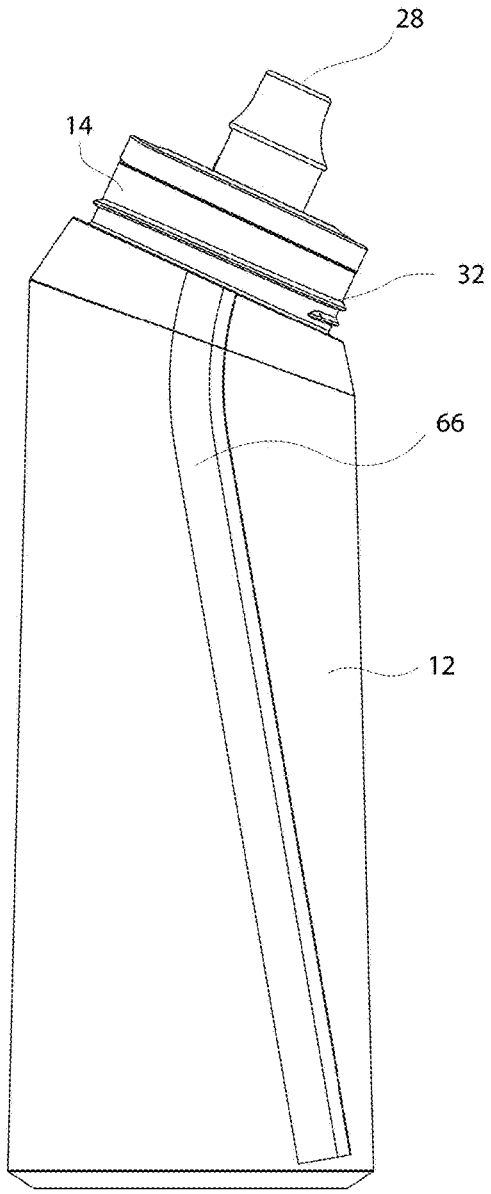
FIG. 3 shows a side view of a drinking device according to the invention according to FIG. 2 without a lid.

In FIGS. 2 and 3, the essential components of the drinking device 10 according to the invention are illustrated. A head part 14 is fastened on the storage container 12 for pure liquid. The head part 14 is clamped into the top opening of the storage container 12, but could also be fastened, for example, via an internal thread not illustrated here on the storage container 12 for pure liquid or via another fastening technique. As apparent from the illustrations according to FIGS. 2 and 3, the head part 14 is arranged at an angle in relation to the longitudinal axis A of the storage container 12. For ergonomic reasons, an angle of approximately $\alpha=25°$ between the longitudinal axis A of the storage container and the longitudinal axis B of the drinking attachment ending at the mouth end 28 has turned out to be particularly advantageous.

As illustrated in FIG. 2, a lid 40 can be screwed onto the head part by means of a thread 32 in order to close the drinking device 10.

Figure 4:
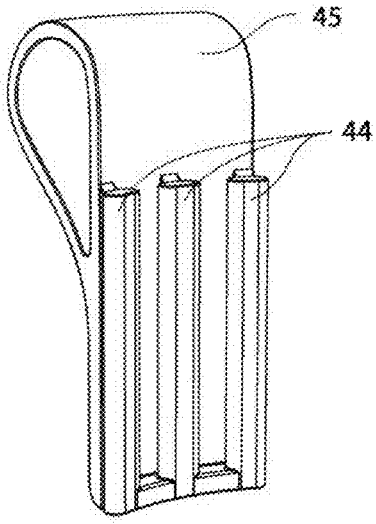
FIG. 4 and FIG. 5 show a carrying strap as well as the fastening geometry for the carrying strap on the lid.
Figure 5:
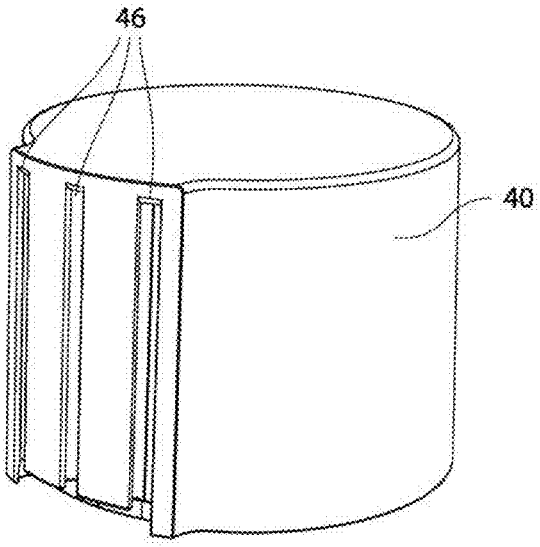

A carrying strap 45, which can be designed to be exchangeable, can be fastened on the lid 40. For this purpose, a connection is provided between the lid 40 and the carrying strap 45, which can easily be undone by the user and which can be designed as a tongue-and-groove system, as illustrated in FIGS. 4 and 5, with one or more tongues 44 at the carrying strap 45 and corresponding grooves 46 at the lid 40. The grooves are tapered to increase friction so that the carrying strap 45 cannot detach itself from the lid unintentionally. The connection illustrated in FIGS. 4 and 5 only constitutes an example, of course, and can be replaced by any other connection that can be easily mounted and unmounted. The carrying strap 45 is preferably made of silicone with a rounded loop so as to avoid tearing when pulled. The two ends are joined downwards so as to cover the form-fitting connection with its technical look.

In FIG. 3, the drinking device 10 is illustrated without the lid so that the head part 14 which is attached in the top opening at the cranked end of the storage container 10 is visible. The head part 14 is clamped into the top opening of the storage container. Preferably, the head part is made of silicone or another elastomer that is sufficiently elastic to be clamped into the top opening of the storage container and tightly seals the top opening. The head part has a mouth end 28 which has an oval design for better ergonomics at the lips. Moreover, the oval shape of the mouth end 28 also enables more precise positioning of the head part 14 on the storage container 12 since the non-circular shape of the mouthpiece provides visual and haptic feedback.

Figure 6:
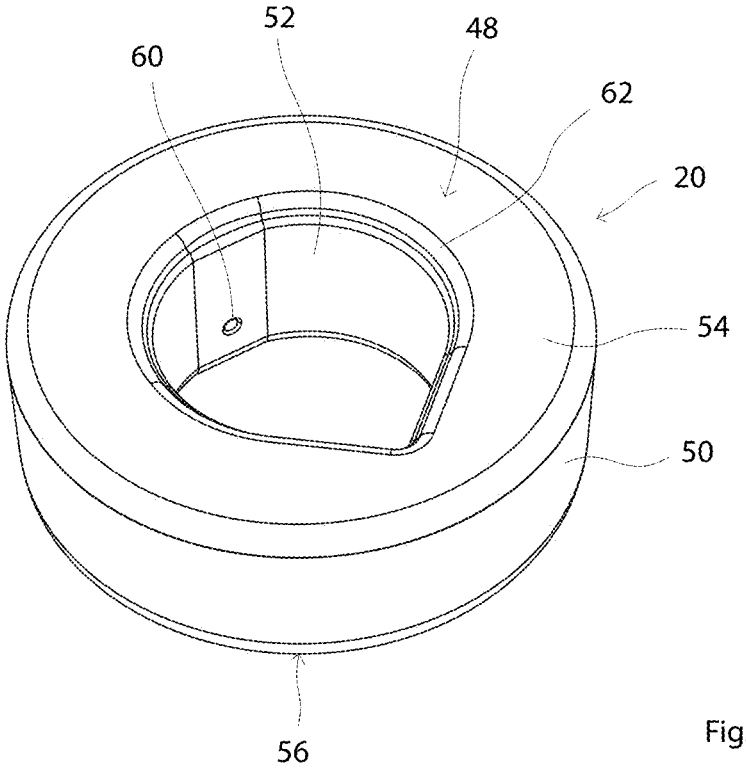
FIG. 6 is a perspective view of an aroma container.

An exchangeable aroma container 20 is attached to the head part 14. The aroma container 20 illustrated in FIGS. 6 and 7 has an annular interior 48 that is enclosed outwards by an annular exterior wall 50, radially inwards by an interior wall 52, at the top by a top side 54 and at the bottom by a lower side 56. In the interior 48, there is a carrier material provided with an aroma substance. The aroma substance is preferably provided in liquid form.

On the lower side 56, a first opening 58 is located through which the ambient air can flow into the interior 48 of the aroma container 20 in the operating position which will be explained below. In the interior wall 52, a second opening 60 is provided through which the air aromatized in the aroma container flows out in the operating position. The first opening 58 and the second opening 60 are spaced as far apart as possible so that the air flowing in through the first opening 58 absorbs as much aroma as possible while flowing through the interior 48, before flowing out through the second opening 60.

Figure 7:
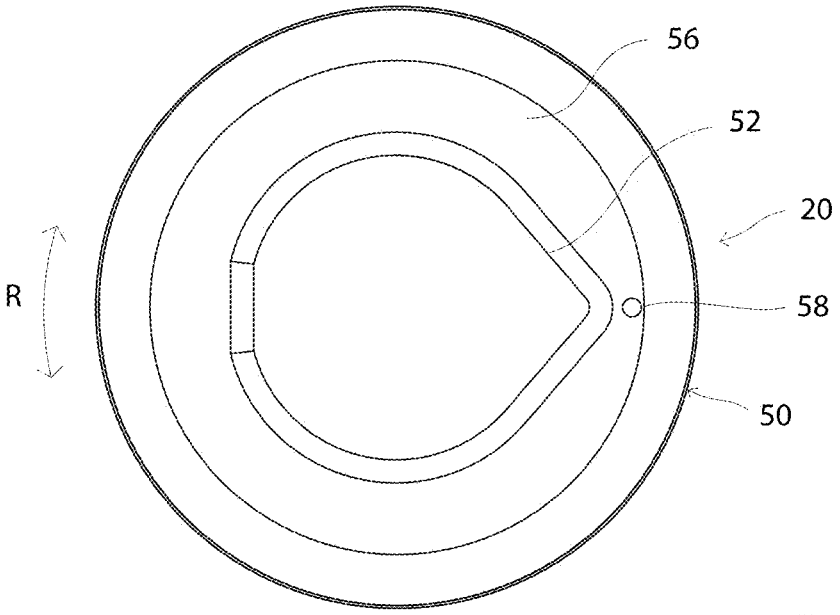
FIG. 7 shows a plan view of the aroma container according to FIG. 6.

As apparent in particular from FIG. 7, the space enclosed by the interior wall 52 has a drop-shaped cross-section. This cross-sectional shape has only been chosen by way of example. However, it is decisive that only a single position is possible with regard to the radial direction R, in which the aroma container 20 can be attached to the mouthpiece.

The top side 54 is designed to be as flat as possible so that a sticker can be attached there to provide information about the flavor of the aroma container 20.

Figure 8:
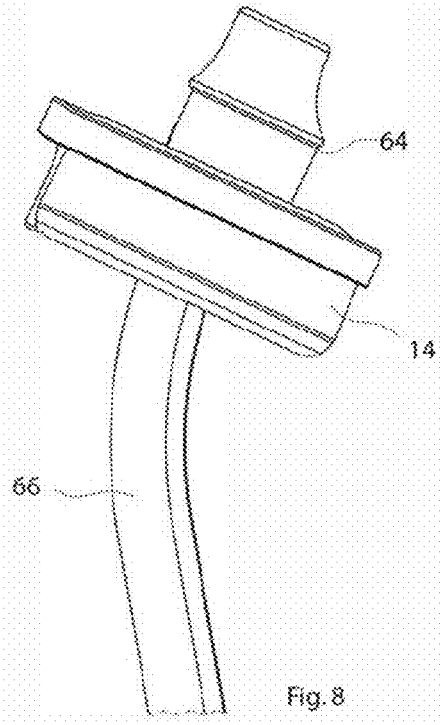
FIG. 8 and FIG. 9 show the head part of the drinking device according to the invention with inserted drinking straw.
Figure 11:
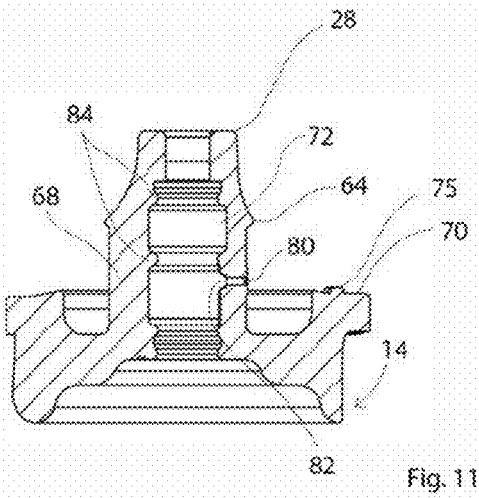
FIG. 11 is a sectional view along section line A-A in FIG. 10.

Furthermore, a step 62 is provided between the interior wall 52 and the top side 54, with which the aroma container 20 abuts in the operating position against a stop 64 at the head part, as shown e.g. in FIGS. 8 and 11.

Additional measures can be provided at the exterior wall 50 so that a user has a secure, good grip of the aroma container, on the one hand, to shift the aroma container between the resting position and the operating position and, on the other hand, to be able to exchange it as well.

Figure 9:
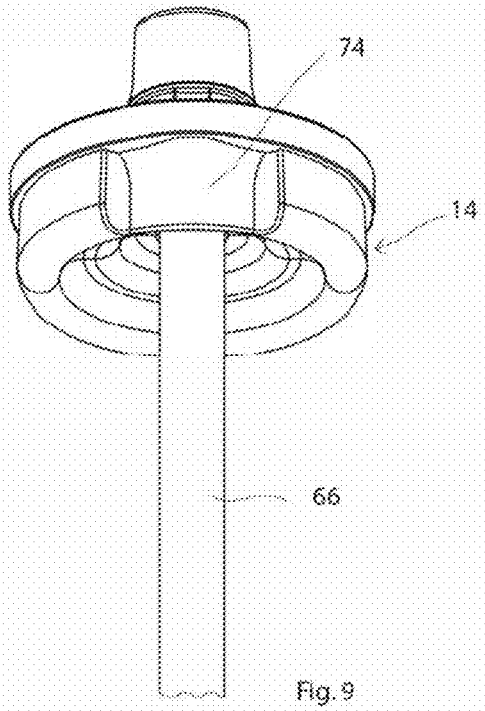

In FIGS. 8 and 9, the head part 14 is shown with a drinking straw 66 fixed therein. When refilling liquid into the container, the head part 14 is taken off together with the drinking straw 66. The head part 14 is formed integrally with the mouth end 28. The oval shape of the mouth end 28 is most easily apparent from FIG. 10. The drinking straw 66 can be separated from the head part 14 to make cleaning easier.

The mouthpiece 68 of the head part 14 is also drop-shaped, however, the exact shapes are preferably not completely complementary to those of the aroma container. The aroma container is supposed to fit tightly against the mouthpiece 68 mainly at the tip and the area diametrically opposite thereto so that there is no play in the area of the openings, but at the same time the friction surface is not too large, in order to facilitate shifting the aroma container 20 in relation to the mouthpiece 68 of the head part 14.

In the inserted state of the aroma container 20 on the mouthpiece 68 of the head part 14, the aroma container is closed and, due to the lower side 56 resting on the surface 70 of the head part 14, no air can flow into the first opening of the aroma container.

The stop 64 limits the axial movement of the aroma container when it is pushed up into the operating position. The stop 64 has a flexible structure inwards by a circumferential cavity 72 to enable an easy exchange of the aroma container, for which purpose the aroma container has to be pulled out upwards over the stop 64.

As illustrated in FIG. 9, an equalizing channel 74 is provided at the head part 14, through which air can escape from the storage container and also flow in while drinking.

When the lid 40 is in place, the equalizing channel 74 is squeezed from above between the edge of the storage container and the lid, thereby providing a seal. When opened, the equalizing channel 74 vents the excess pressure outwards. At the same time, the equalizing channel 74 is designed in such a way that no water remains in the equalizing channel so that no water can squirt from the opening when opened.

Figure 14:
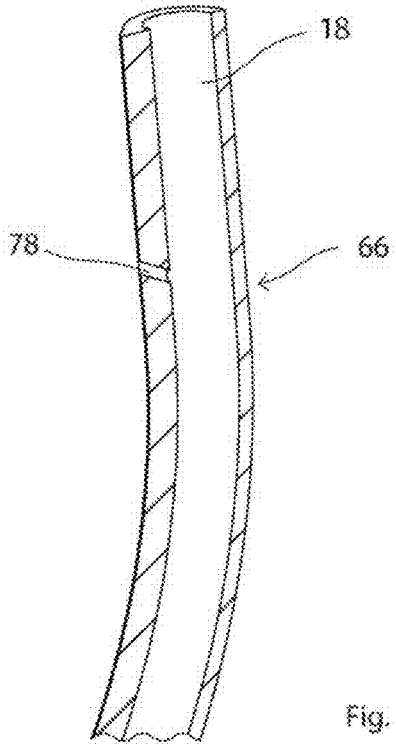
FIG. 14 shows a sectional view of the drinking straw.

The opening for the drinking straw also adopts the drop shape, thus ensuring the precise positioning of the drinking straw in the head part. When it is pushed in, the drinking straw abuts against a stop in the head part. Due to the stop as well as the cross-sectional shape, the position of the air channel 78 in the drinking straw 66, as illustrated in FIG. 14, is fixed both axially and radially, and is thus positioned in relation to the head part.

In the head part 14, an inlet opening 80 is formed which is illustrated in FIG. 11. This opening 80 communicates with an equalizing chamber 82 in the head part, which serves as buffer and can equalize overpressure and negative pressure generated during and after drinking and thus prevents water from flowing into the aroma container. When assembled, the equalizing chamber 82 is formed as a space between the head part 14 and the drinking straw 66 that is not shown in FIG. 11. Suitable stabilization fins are provided within the equalizing chamber 82 to ensure sufficient stability of the head part in the area of the inlet opening 80 so that the desired seal is provided between the aroma container and the head part.

Finally, sealing lips 84 are provided in the mouthpiece of the head part 14, which delimit the different areas in the opening from each other and prevent dirt from entering the functional locations.

Figure 10:
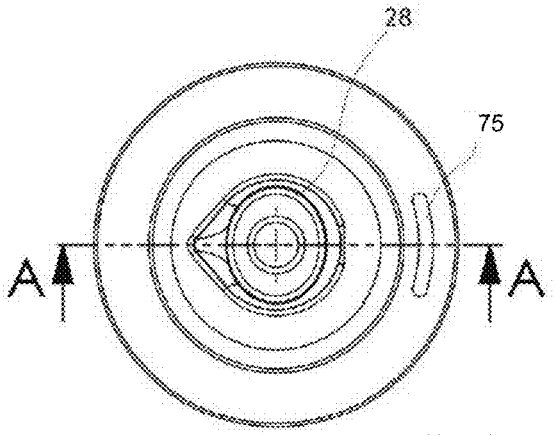
FIG. 10 is a plan view of the head part.

As shown in FIG. 10, a marking in the form of an elevation 75 is provided on the head part 14, which indicates to the user where to put the thumb to easily detach the head part from the storage container.

Figure 12:
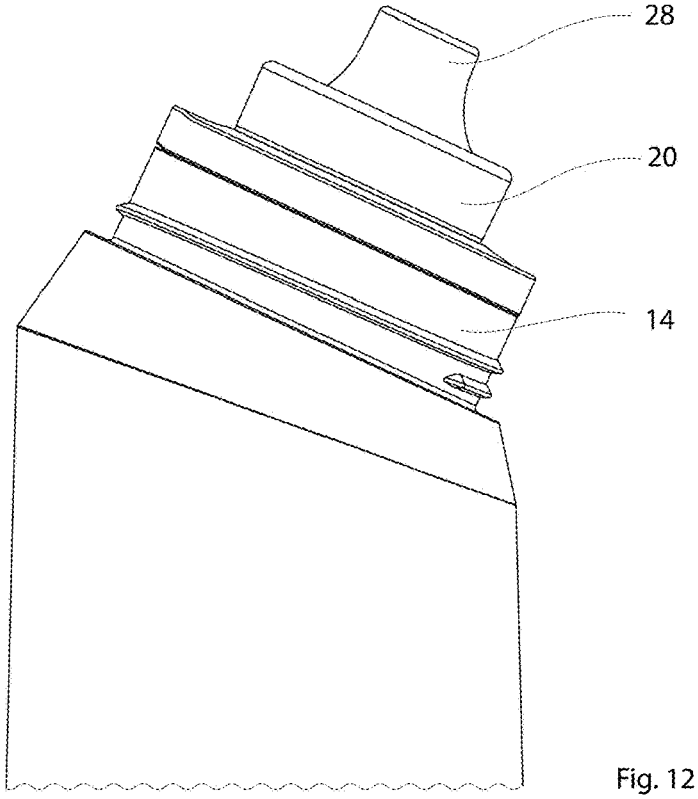
FIG. 12 and FIG. 13 show the two operating states of the drinking device according to the invention.
Figure 13:
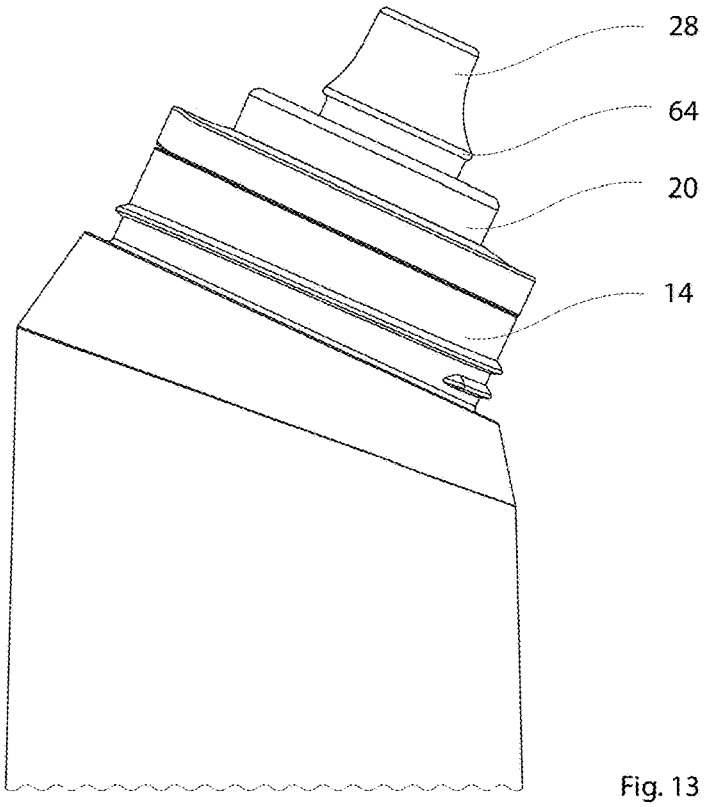

In FIGS. 12 and 13, the aroma container 20 is illustrated in the operating position. By comparison, FIG. 13 shows the locked position of the aroma container 20. In the operating position, the top side of the aroma container 20 abuts against the stop 64 so that it is clearly recognizable for the user when the aroma container is in the operating position. Only in the operating position, as illustrated in FIG. 12, can air flow in through the first opening and the aromatized air flow out through the second opening and enter the head part 14 through the opening 80 aligned therewith and enter from the equalizing chamber 82 following the opening 80 into the air channel 78 in the drinking straw.

In FIG. 14, a sectional view of the drinking straw 66 is illustrated in which the transport channel 18 for drinking liquid as well as the air channel 78 is located. The drinking straw also has a drop-like cross-sectional shape. As also illustrated in FIG. 3, the drinking straw 66 is curved so that it ends close to the lowest point of the storage container during drinking, when the storage container is held in a slightly inclined way, so that it is possible to consume the liquid in the storage container almost completely.

Figure 15:
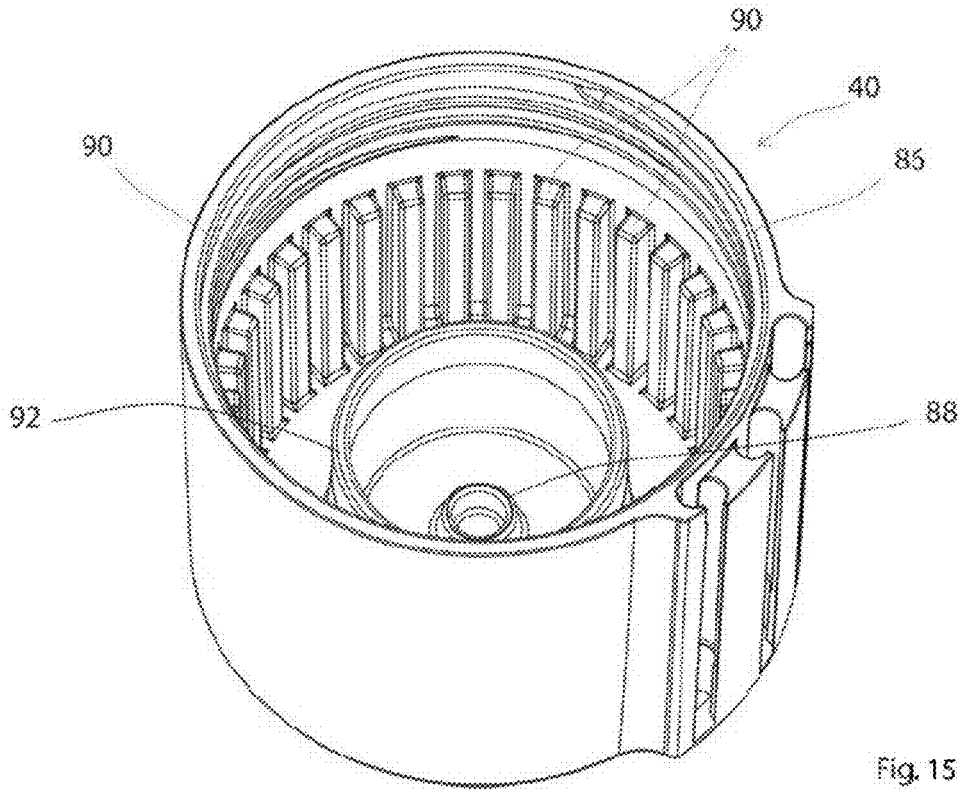
FIG. 15 illustrates the interior of the lid.

In FIG. 15, the lid 40 is illustrated. The lid has an internal thread 86 with which the lid can be screwed onto the thread 32 on the head part. When screwed on, the lid performs several functions. Firstly, a sealing plug 88 is integrally molded with which the mouthpiece is sealed. Moreover, a plurality of fins 90 are provided on the interior circumference of the lid 40 which, when closed, press flatly against the external edge of the area 70 of the mouthpiece and thus seal the equalizing channel. This seal can also be provided by a different protrusion, not shown here, at the level of the end of the fins. Finally, an annular ledge 92 is provided with which the aroma container 20 is shifted into the locked position illustrated in FIG. 13 while the lid 40 is being screwed onto the head part 14, After drinking, a user thus no longer has to shift the aroma container 20 from the operating position illustrated in FIG. 12 to the locked position illustrated in FIG. 13, but merely has to screw on the lid 40.

With the drinking device according to the invention, the aroma is merely perceived orally and there is thus no orthonasal impression of smell, Due to the oral perception of the aroma, the taste impression is created in the user solely via the retronasal perception of the aroma substance and is only perceived by the consumer via the enteral route in negligible quantities, if at all. Even complex aromas and aroma mixtures can be created which do not require long-term stabilization in the drinking liquid and are not swallowed by the user either.

The invention claimed is:

1. A drinking device for the retronasal perception of an aroma substance, the drinking device comprising:

a storage container for drinking liquid;

a head part configured to be fastened on the storage container, the head part having a mouth end;

a lid which can be screwed onto the head part of the drinking device and has a connection for attaching a carrying strap;

an exchangeable aroma container through which air can flow, the exchangeable aroma container configured to be fastened on the head part; and a drinking straw fixed in the head part, the drinking straw comprising:

a transport channel for drinking liquid, the transport channel extending from the storage container towards the mouth end of the head part; and an air channel for transporting aromatized air, the air channel extending from the aroma container towards the mouth end of the head part or towards the transport channel.

2. The drinking device according to claim 1, wherein the exchangeable aroma container can be moved, in relation to the head part, in an axial direction from a sealing position to a non-sealing position.

3. The drinking device according to claim 1, further comprising: a pressure equalizing channel closing an air supply line that leads into the interior of the storage container for drinking liquid.

4. The drinking device according to claim 1, wherein the head part is arranged at an angle in relation to a longitudinal axis of the storage container.

5. The drinking device according to claim 1, wherein the drinking straw has a sectional curvature in a longitudinal direction.

6. The drinking device according to claim 1, wherein the head part has an air chamber in connection with the air channel.

7. An aroma container for a drinking device for the retronasal perception of an aroma substance, the drinking device comprising:

a storage container for drinking liquid;

a head part configured to be fastened on the storage container, the head part having a mouth end;

an exchangeable aroma container through which air can flow, the exchangeable aroma container configured to be fastened on the head part; and a drinking straw fixed in the head part, the drinking straw comprising:

a transport channel for drinking liquid, the transport channel extending from the storage container towards the mouth end of the head part; and an air channel for transporting aromatized air, the air channel extending from the aroma container towards the mouth end of the head part or towards the transport channel, the aroma container comprising:

an essentially annular aroma chamber comprising a carrier substance that contains a fluid with an aromatizing substance; wherein the aroma chamber is enclosed by a wall which comprises an interior circumferential surface, an exterior circumferential surface, a top side and a lower side; wherein the interior circumferential surface has a non-circular cross-section and is shaped in such a way that the aroma container can only be put in a single rotational direction onto a component shaped complementarily to the interior circumferential surface and can be shifted in an axial direction essentially perpendicular to the top side in relation to the component;

at least one first opening for air to flow in; and at least one second opening for air to flow out.

8. The aroma container according to claim 7, wherein the at least one first opening for air to flow in is arranged in the lower side of the wall.

9. The aroma container according to claim 7, wherein the at least one second opening for air to flow out is arranged in the interior circumferential surface.

10. A drinking device for the retronasal perception of an aroma substance, the drinking device comprising:

a storage container for drinking liquid, the storage container having a longitudinal axis;

a head part configured to be fastened on the storage container, the head part having a mouth end, the head part being arranged at an angle in relation to the longitudinal axis of the storage container, wherein the head part is inclined at an angle between 20° and 30° in relation to the longitudinal axis of the storage container;

an exchangeable aroma container through which air can flow, the exchangeable aroma container configured to be fastened on the head part; and a drinking straw fixed in the head part, the drinking straw comprising:

a transport channel for drinking liquid, the transport channel extending from the storage container towards the mouth end of the head part; and an air channel for transporting aromatized air, the air channel extending from the aroma container towards the mouth end of the head part or towards the transport channel.

11. The drinking device according to claim 10, wherein the head part is inclined at an angle of approximately 25° in relation to the longitudinal axis of the storage container.

* * * * *